United States Patent [19]

Eicker

[11] Patent Number: 5,041,073

[45] Date of Patent: Aug. 20, 1991

[54] APPARATUS FOR CUTTING OFF AND APPLYING TEAR-OFF STRIPS TO A WEB OF PACKAGING MATERIAL

[75] Inventor: Hans Peter Eicker, Ennepetal, Fed. Rep. of Germany

[73] Assignee: 501 Maschinenfabrik Alfred Schmermund GmbH & Co., Gevelsberg, Fed. Rep. of Germany

[21] Appl. No.: 521,811

[22] Filed: May 10, 1990

[30] Foreign Application Priority Data

May 10, 1989 [DE] Fed. Rep. of Germany ..... 3915285

[51] Int. Cl.[5] ..... B31B 1/90

[52] U.S. Cl. ..... 493/377; 493/345; 493/349; 493/930; 493/963; 156/519

[58] Field of Search ..... 493/210, 214, 220, 223, 493/345, 349, 341, 347–348, 377, 380, 382, 963, 930; 156/519

[56] References Cited

U.S. PATENT DOCUMENTS

| | | | |
|---|---|---|---|
| 2,723,604 | 10/1951 | Fischer | 493/345 |
| 2,766,665 | 3/1953 | Van Arsdell | 493/345 |
| 3,146,152 | 8/1964 | Seragnoli | 156/519 |
| 3,159,521 | 12/1960 | Pechmann | 493/375 |
| 3,395,064 | 7/1968 | Schmermund | 156/519 |
| 3,957,570 | 5/1976 | Helm | 156/519 |
| 4,083,737 | 4/1978 | Foote, Jr. et al. | 156/73.1 |

FOREIGN PATENT DOCUMENTS

| | | |
|---|---|---|
| 1167731 | of 0000 | Fed. Rep. of Germany . |
| 1249067 | of 0000 | Fed. Rep. of Germany . |
| 1586120 | of 0000 | Fed. Rep. of Germany . |

*Primary Examiner*—Frederick R. Schmidt
*Assistant Examiner*—John A. Marlott
*Attorney, Agent, or Firm*—Townsend and Townsend

[57] ABSTRACT

An apparatus for cutting tear-off strips from a strip of material having a width equal to the length of the tear-off strip and for applying the tear-off strip to a conveyed web of packaging material is disclosed. The apparatus has one movable and one stationary straight knife for the progressive cutting of the strip, a device to which suction can be applied for transferring the cut strip along its longitudinal axis to a suction roll, the suction roll being partially covered by the continuously conveyed packaging material. The strip is conveyed to the roll and the combination passes through a welding device for welding the tear-off strip to the web of packaging material. In order to operate at higher cycle rates, the device has a suction wheel for transferring the strip, which conveys the strip to the suction roll, the suction wheel being virtually motionless at the pick up position of the strip and being accelerated to the transfer point of the suction roll until the speeds of the suction wheel and roll are roughly the same.

4 Claims, 1 Drawing Sheet

APPARATUS FOR CUTTING OFF AND APPLYING TEAR-OFF STRIPS TO A WEB OF PACKAGING MATERIAL

BACKGROUND OF THE INVENTION

This invention is in the field of plastic cutting machinery. More particularly, it is an apparatus for cutting tear-off strips from a strip of plastic whose width is equal to the length of the tear-off strip and for applying the tear-off strips to a piece of packaging material. The apparatus has one movable and one stationary straight knife for the progressive cutting of the tear-off strips. A device to which suction can be applied transfers the tear-off strip along its longitudinal direction to a suction roll rotating at the same speed as the packaging material is moving. The suction roll picks up and is partially wrapped about by the continuously conveyed packaging material. The tear-off strip is also picked up by the suction roll and overlays the packaging material. A welding device welds the tear-off strip to the web of packaging material.

German reference DE-B-1,167,731 shows the use of one stationary and one movable knife in an apparatus for cutting off and applying tear-off strips. The knives are arranged at a slight angle to one another, in order to produce a "pulling" cut. The movable knife may have suction air applied to it, in which case the knife transfers the cut tear-off strip, held in place by the suction air, to a guide shoe which may also have suction air applied to it. The tear-off strip projects beyond the guide shoe so that it can be picked up by a continuously rotating drum, the drum also having suction air. A web of packaging material, to which the tear-off strip will be welded, is also held by the drum. With high packaging rates and a fast rotating drum, the tear-off strips cut by this apparatus cannot be reliably picked up. There is a risk that the cut tear-off strip will remain in the guide shoe and jam the entire apparatus, as the next cut tear-off strips cannot be held by the guide shoe, until the previously cut strip has been removed from the vacuum holes in the rotating drum. German Reference DE-B-1,249,067 also shows an apparatus for cutting a tear-off strip. Two knives bent in the form of an arc are used, resulting in a "striking" cut. In this machine the tear-off strip is cut from a web of tear-off strips and is transferred directly to a suction roll which is partially wrapped by a web of packaging material.

The apparatus shown in DE-A-1,586,120 has the tear-off strips being applied transversely to the conveying direction of the packaging material. The conveying takes place using a multi-knife roll and the aid of suction air. In this case the tear-off strips are self-adhesive and can simply be pressed onto the web of packaging material, without having to be further transported.

In German Reference DE-A-3,423,295, a knife arrangement with the knives being arranged obliquely with respect to the transport path of the web of packaging material is shown. The movable knife, which holds a cut tear-off strip by means of suction air, can be pivoted out of the cutting position into a position above the web of packaging material, and can deposit the cut-off tear-off strip onto it. During further transport the tear-off strip is welded to the web of packaging material. A relatively large range of motion is required by the movable knife, which restricts the cycle rates, as relatively large masses are moved. Additionally, adjustment is complicated and the tear-off strip is not guided after being deposited onto the web of packaging material, which means that it can go astray. Also, the web of packaging material has to be conveyed intermittently, as the tear-off strip cannot be deposited on a moving web of packaging material.

SUMMARY OF THE INVENTION

The object of the invention is to create an apparatus for cutting and transporting tear-off strips, which, during progressive cutting, achieves reliable transport of the cut strips to the web of packaging material to which they are to be applied and does so at a very high cycle rate.

The device has a suction wheel for transferring the strips, which conveys the strips from one end to the suction roll, the suction wheel being virtually at a standstill at the take-up position relative to the strip and accelerating to the speed of the roll at the transfer point to the roll.

In this arrangement, the tear-off strip is periodically pulled by a bobbin, the axis of which is arranged in parallel to the web of packaging material, and cut off. With the aid of suction holes, which are located in the knife holder of the movable knife, the tear-off strip is transferred to a suction wheel, which rotates intermittently and is briefly motionless during the transfer of the strip to the wheel. The suction wheel transfers the tear-off strip to a suction roll, which rotates continuously and at the same speed as the packaging material. The two rolls run synchronously at the instant of transfer. During further transport the small strip is clamped between the suction roll and the packaging material and welded to the packaging material upon passing through a heating device. A preferred embodiment of the invention is described in more detail below with reference to FIGS. 1 and 2.

DESCRIPTION OF THE SPECIFIC EMBODIMENT(S)

Figure 1:
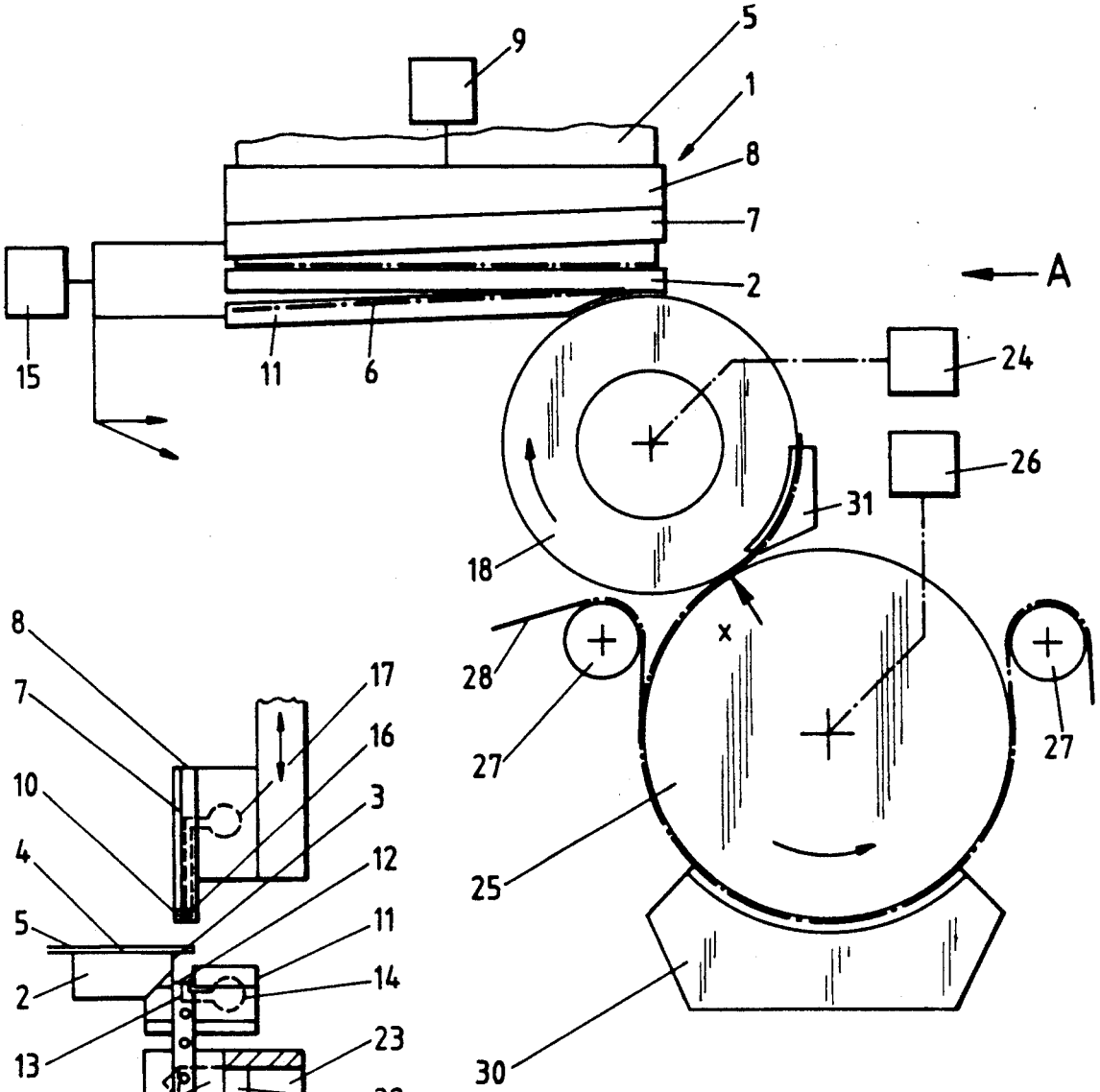
FIG. 1 is a diagrammatic drawing of a preferred embodiment of the present invention.
Figure 2:
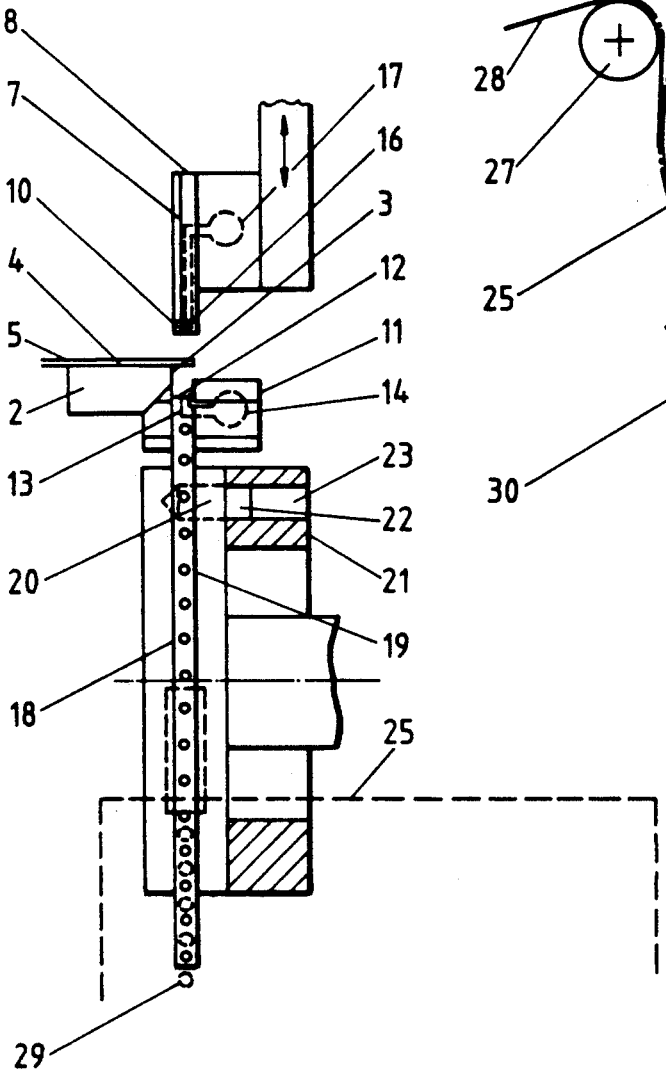
FIG. 2 shows a side view of the present invention taken along the axis of arrow A in FIG. 1.

The apparatus shown in FIGS. 1 and 2 comprises a knife arrangement 1 having a stationary knife 2, which has a straight cutting edge 3 and a supporting and guiding surface 4 for a strip of material 5, which is supplied by a bobbin (not shown) operating intermittently with an advance stroke whose distance of movement is equivalent to the width of the tear-off strip 6 to be cut from strip 5, the cut being transverse to the direction of the movement of the material. The knife arrangement additionally comprises a knife 7, which is supported by knife holder 8, which in turn can be moved up and down by drive 9 (indicated in diagrammatic form). Movable knife 7 is arranged obliquely in this embodiment at an inclination of 1° with respect to stationary knife 2. During the downward stroke of knife 7, its straight cutting edge 10 moves progressively along the cutting edge 3 of stationary knife 1. In this way, tear-off strip 6 is progressively cut from strip of material 5.

Underneath guide surface 4 of knife 2, a stationary guide shoe 11 with a guide groove 12 is located. The guide groove extends parallel to cutting edge 10 of movable knife 7. Suction air openings 13 are connected by a suction air duct 14 to a suction air source 15 and open in guide groove 12 at the base of the groove. Suction air openings 16, which are connected by suction air duct 17 to suction air source 15, similarly open on the underside of knife holder 8.

As tear-off strip 6 is cut off from strip of material 5, strip 6 is progressively held in place by suction air through suction air openings 16 in knife holder 8 and conveyed by the downward stroke of the knife holder into guide groove 12 of guide shoe 11. At the end of the downward stroke of knife holder 8, the supply of suction air to its suction air openings 16 is halted and suction air openings 13 in guide groove 12, which now receive suction air, cause strip 6 to be held in guide groove 12.

Guide shoe 11 does not extend across the entire width of strip 5, so that one end of strip 6 projects beyond the guide shoe at its upper end. Guide shoe 11 is essentially tangential to the circumference of suction wheel 18. Suction wheel 18 is provided about its circumference with suction air openings 19, which are connected by bores 20 to suction air source 15, with suction air control 21 controlling the flow of suction air to openings 19.

Suction air control 21 may comprise a ring arranged in contact with suction wheel 18, the ring having an annular groove 22 connected to a suction air line 23, the groove 22 extending across the area upon which the application of suction air is to act. Bores 20 are then connected to groove 22, which is open on the side facing the bores 20.

The suction wheel 18 has a cam drive 24 (indicated diagrammatically) such that, at the moment the tear-off strip 6 begins to be picked up, while the strip is still held by guide shoe 11, suction wheel 18 almost stops. As a result of the suction air acting through suction air openings 19, the end of strip 6 projecting out of the guide shoe 11 is picked up by the wheel 18 and moved away with corresponding acceleration.

A suction roll 2 is provided which is driven continuously by drive 26 (indicated diagrammatically). A web of packaging material 28 (usually transparent film) is guided around the suction roll 25 by means of two guide rolls 27.

Suction roll 25, whose width corresponds essentially to the width of the web of packaging material 28, picks up strip 6 from suction wheel 18 at a transfer point X, the width of the roll being at least equal to the width of strip 6. Suction wheel 18 is accelerated to the speed of suction roll 25, with the result that there is virtually no relative motion between suction wheel 18 and suction roll 25 at transfer point X. At transfer point X the supply of suction air to suction air openings 19 in suction wheel 18 is interrupted, while the supply of suction air to corresponding suction air openings 29 of suction roll 25 is begun. As a result, the suction roll 25 transports the tear-off strip 6 along its surface between the surface and the web of packaging material 28 partially wrapped around the suction roll 25. A heating shoe 30, which extends along the path of the tear-off strip 6 over a section of the circumference of the suction roll 25, welds the strip to the web of packaging material.

Suction air from suction air source 15 may be applied to suction air openings 29 in suction roll 25 in the same way as the suction air openings 19 in suction wheel 18.

Guide shoe 31 is expediently provided for the tear-off strip 6 before transfer point X. The guide shoe surrounds the suction wheel 18 at its circumference and ensures that strip 6 cannot become misaligned.

The transfer point X is expediently less than 180° away from the take-over position for strip 6 from the guide shoe 11, which means that the suction wheel 18 may again be brought virtually to a halt over the distance remaining between transfer point X and 180° therefrom, so that the wheel will again be ready to pick up a new strip 6 almost without relative motion thereto.

Suction air openings 16 may also be located on movable knife 7, but it is easier to use a thin and therefore relatively lightweight knife 7 made of steel and to arrange the suction air openings 16 in knife holder 8, the knife holder being made from, for example, aluminum, in which bores can be made easily. This also results in smaller masses being moved.

The present invention has been described in one preferred embodiment. Nothing herein should be taken to limit this invention to only that embodiment. In particular, the details of materials and spacing between components can be changed without any effect on the essence of this invention. Potential applications of the invention are also not limited to those described herein. Consequently, this specification should be read and interpreted in a broad, not narrow sense. The scope of the invention is defined in the claims appended hereto.

I claim:

1. An apparatus for cutting a tear-off strip from a sheet of material having a width equal to the length of the tear-off strip and for applying the tear-off strip to a piece of packaging material, the apparatus comprising:

cutting means for cutting the tear-off strip from the material, the cutting means comprising an upper movable cutting means and a lower stationary cutting means, the upper and lower cutting means cooperating to cut the tear-off strip from the sheet of material, the cutting occurring in a manner whereby a first end of the tear-off strip is cut before the second end of the tear-off strip;

transport means receiving the tear-off strip from the cutting means and for moving the tear-off strip in its longitudinal direction, the transport means comprising a cylindrical drum means, the surface of the drum means having a guide groove therein, a plurality of holes penetrating the guide groove and being in turn coupled to a source of low air pressure, the transport means receiving the tear-off strip from the cutting means, holding the tear-off strip in the guide groove by means of the low air pressure, and conveying the tear-off strip to a rotating holding means, the transport means rotating at a varying speed, the rate being slowest as the tear off strip is cut from the sheet of material, and then accelerating to match the rotation rate of the rotating holding means so that the transfer of the tear-off strip to the rotating holding means occurs when there is no relative motion between the rotating holding means and the transport means; and welding means for joining the tear-off strip and packaging material as they are held together by the rotating holding means.

2. The apparatus of claim 1 wherein the rotating holding means is cylindrical with a plurality of holes in its outer surface, the holes being coupled to a source of low air pressure, the rotating holding means receiving the packaging material, holding it by means of the low air pressure provided by the holes, receiving the tear-off strip from the transport means and holding the tear-off strip from the transport means by means of the vacuum provided by the holes.

3. The apparatus of claim 1 wherein the welding means presses against the surface of the rotating holding means for welding the tear-off strip to the packaging material.

4. The apparatus of claim 3 wherein the welding means comprises an annular heating shoe which surrounds the rotating holding means.

* * * * *